US007407569B2

(12) United States Patent
Mizutani et al.

(10) Patent No.: US 7,407,569 B2
(45) Date of Patent: Aug. 5, 2008

(54) GOLD PLATING SOLUTION AND GOLD PLATING METHOD

(75) Inventors: Fumikazu Mizutani, Fukuoka (JP); Hiroshi Takaha, Kanagawa (JP); Makoto Ishikawa, Fukuoka (JP); Yasuhiro Kawase, Fukuoka (JP)

(73) Assignee: Mitsubishi Chemical Corporation, Tokyo (JP)

( * ) Notice: Subject to any disclaimer, the term of this patent is extended or adjusted under 35 U.S.C. 154(b) by 403 days.

(21) Appl. No.: 10/937,392

(22) Filed: Sep. 10, 2004

(65) Prior Publication Data

US 2005/0056545 A1 Mar. 17, 2005

Related U.S. Application Data

(63) Continuation-in-part of application No. PCT/JP03/02857, filed on Mar. 11, 2003.

(30) Foreign Application Priority Data

Mar. 13, 2002 (JP) ..... 2002-068691

(51) Int. Cl.
*C25D 3/48* (2006.01)

(52) U.S. Cl. ..... 205/234; 205/247; 205/267

(58) Field of Classification Search ..... 205/234, 205/247, 267
See application file for complete search history.

(56) References Cited

U.S. PATENT DOCUMENTS

| | | | | |
|---|---|---|---|---|
| 4,375,984 | A * | 3/1983 | Bahl et al. | 75/715 |
| 4,557,759 | A * | 12/1985 | McGrew et al. | 75/712 |
| 4,632,743 | A | 12/1986 | Yoshikumi et al. | |
| 4,734,171 | A * | 3/1988 | Murphy | 205/566 |
| 4,832,743 | A | 5/1989 | Perovetz et al. | |
| 4,859,293 | A | 8/1989 | Hirako et al. | |
| 4,999,054 | A | 3/1991 | Perovetz et al. | |
| 5,026,420 | A * | 6/1991 | Kubo | 75/712 |
| 5,210,638 | A * | 5/1993 | Eid et al. | 359/265 |
| 5,897,695 | A * | 4/1999 | Mayo et al. | 106/31.75 |
| 6,248,655 | B1 * | 6/2001 | Machida et al. | 438/597 |
| 6,833,275 | B1 * | 12/2004 | Nichtl | 436/528 |

FOREIGN PATENT DOCUMENTS

| | | |
|---|---|---|
| GB | 1 526 215 | 9/1978 |
| JP | 60-245797 | 12/1985 |
| JP | 1-119680 | 5/1989 |
| JP | 8-41676 | 2/1996 |
| JP | 10-317183 | 12/1998 |
| JP | 11-61480 | 3/1999 |
| JP | 11-293487 | 10/1999 |
| JP | 2000-204496 | 7/2000 |
| JP | 2000-355792 | 12/2000 |
| JP | 2001-110832 | 4/2001 |

* cited by examiner

*Primary Examiner*—Susy Tsang-Foster
*Assistant Examiner*—William T. Leader
(74) *Attorney, Agent, or Firm*—Oblon, Spivak, McClelland, Maier & Neustadt, P.C.

(57) ABSTRACT

A gold plating solution comprising iodide ions, gold iodide complex ions and a non-aqueous solvent, which is less toxic and stable, while having a performance comparable to a cyanide type gold plating solution. The present invention further provides a gold plating solution comprising iodide ions, gold iodide complex ions, a non-aqueous solvent and a water-soluble polymer, which is less toxic and stable, while having a performance comparable to a cyanide type gold plating solution and which is capable of forming a gold plating film in which gold crystal particle sizes are very fine and grain boundaries are dense. The present invention further provides a gold plating method employing such a gold plating solution.

21 Claims, No Drawings

GOLD PLATING SOLUTION AND GOLD PLATING METHOD

BACKGROUND OF THE INVENTION

1. Field of the Invention

The present invention relates to a gold plating solution and a gold plating method, particularly to a noncyanide type electrolytic plating solution and a gold electroplating method employing such a gold plating solution.

2. Discussion of Background

As a gold plating solution, a cyanide type plating solution has been known from long ago. By using a cyanide type gold plating solution, it is possible to deposit a gold plated film having excellent characteristics such that it is dense and has a smooth surface. Besides, the cyanide type plating solution is stable, and its control is easy. Accordingly, it is widely used. However, cyanide has a strong toxicity and has had many problems with respect to the working environment, the waste liquid treatment, etc.

Therefore, various noncyanide type low toxicity gold plating solutions have been proposed. For example, a gold plating solution has been widely used wherein gold sulfite is dissolved (JP-A-11-61480). However, with this gold plating solution, sulfite ions in the solution tend to be readily oxidized by dissolved oxygen or oxygen in the atmosphere, and the useful life as a gold plating solution tends to be short. Accordingly, it has been required to take a measure to prevent oxidation, e.g. by nitrogen sealing, during the storage or even during the plating operation, and thus, there has been a problem that its handling is cumbersome.

Further, a gold plating solution is also proposed in 10 which a thiosulfate/gold complex, a sulfite, boric acid and ethylene glycol are dissolved (JP-A-51-47539). However, also this gold plating solution has had the same problems as the above-mentioned gold plating solution employing gold sulfite, since sulfite ions in the plating solution tend to be oxidized.

Further, a gold plating solution obtained by dissolving a gold compound selected from the group consisting of various gold complexes such as acetylcysteine/gold complexes, and acetylcysteine as a complexing agent, or a gold plating solution containing at least one alkane sulfonic acid or alkanol sulfonic acid, gold ions and a non-ionic surfactant, has, for example, been proposed (JP-A-10-317183, JP-A-8-41676). However, like the gold plating solution containing gold sulfite, each of them contains monovalent gold ions, whereby deposition of gold by the reaction $3Au^{+} \rightarrow 2Au + Au^{3+}$ is likely to take place, and thus, there is a problem of instability of the gold plating solution.

Therefore, a gold plating solution has been proposed wherein an ethylene diamine/gold complex as trivalent gold ions is dissolved (JP-A-11-293487, JP-A-2000-204496, JP-A-2000-355792, JP-A-2001-110832). However, ethylene diamine has a problem of harmful effects such that there have been cases of accidental death due to percutaneous and inhalation exposure (Chemical Substance Toxicity Handbook vol. II, II-84, (1999) published by Maruzen). Accordingly, a gold plating solution is desired which is safe and excellent in handling efficiency.

Further, after the applicants' Japanese Patent Application No. 2002-068691 filed on Mar. 13, 2002 from which the priority is claimed in the present application, a case has been reported wherein a gold plated film of black color was obtained by carrying out gold plating in the presence of an organic solvent when gold electroplating was carried out by means of a gold solution having gold dissolved in a solution containing iodine ($I_2$) and iodide ions ($I^-$) (2002 National Science Education General Assembly, vol. 24, p. 66-67). However, in this case, the crystal particles of gold in the gold plated film formed were coarse, whereby the gold plated film exhibited a black color, and a glossy beautiful gold plated film was not obtained.

As mentioned above, the prior art has had problems such as 1) a problem in the working environment or waste liquid treatment due to a toxic substance, 2) low chemical stability such as susceptibility to oxidation, and 3) thickening growth of gold crystal particles in the gold plated film. Especially when the gold crystal particles in a gold plated film are coarse, glossiness or smoothness of the gold plated film tends to be low, and it tends to be difficult to apply such a film to ornamental or electronic components. Accordingly, a gold plating solution is desired which is safe, chemically stable and excellent in handling efficiency and which is, at the same time, capable of forming a smooth gold plated film wherein gold crystal particles are fine and dense.

SUMMARY OF THE INVENTION

It is an object of the present invention to solve the above-mentioned problems of the prior art and to provide a gold plating solution which does not contain cyanide or the like having a strong toxicity and having a problem in the waste liquid treatment or working environment, is excellent in chemical stability, requires no special measure for preventing oxidation, and can easily and safely be handled in the atmosphere. Another object of the present invention is to provide such a gold plating solution whereby gold crystal particles in the gold plated film to be formed are fine, dense and excellent in the surface smoothness, and which is suitable for gold plating on an ornamental article desired to have a high surface smoothness and glossiness or on an electronic component such as a connector terminal or a printed circuit board, and a gold plating method employing such a gold plating solution.

The present inventors have conducted an extensive study on the above problems and have paid attention to an aqueous solution containing iodine ($I_2$) and iodide ions ($I^-$), which is known as a solution capable of dissolving gold in the form of gold iodide complex ions. It has been found that when gold electroplating (which may hereinafter sometimes be referred to simply as "gold plating") is carried out in an aqueous gold solution obtained by dissolving gold in this aqueous solution, if gold plating is carried out in the presence of a non-aqueous solvent, it is possible to suppress electrolysis of water and to obtain a good gold plated film. The present invention has been accomplished on the basis of this discovery.

Namely, according to the first aspect, the present invention provides a gold plating solution comprising iodide ions, gold iodide complex ions and a non-aqueous solvent, and a gold plating method employing such a gold plating solution.

As a result of a further study, the present inventors have found that when gold electroplating is carried out with a gold solution containing iodine ($I_2$) and iodide ions ($I^-$), known as a solution having gold dissolved in the form of gold iodide complex ions, if a water-soluble polymer which is soluble in this gold solution, is added together with a non-aqueous solvent, gold crystal particles in the resulting gold plated film will be very fine, and it is possible to obtain a gold plated film wherein crystal grain boundaries are dense. A second aspect of the present invention has been accomplished on the basis of this discovery.

Thus, according to the second aspect, the present invention provides a gold plating solution comprising iodide ions, gold iodide complex ions, a non-aqueous solvent and a water-soluble polymer, and a gold plating method employing such a gold plating solution.

The details of the reason for the formation of a gold plated film having such fine crystal particles by incorporating a non-aqueous solvent and a water-soluble polymer to the gold plating solution, are not clearly understood. However, it is considered that by the presence of a non-aqueous solvent, generation of gas due to the hydrolysis of water at the cathode will be suppressed, and by the addition of a water-soluble polymer, an interaction of gold/iodine element/the water soluble polymer takes place to control the crystal orientation during reduction of gold ions, thereby to promote microsizing of gold crystal particles, and at the same time to improve the efficiency for reduction and deposition.

Here, the particle size of gold crystals may be obtained by counting the number of gold crystal particles per unit area by an upper surface observation by a scanning electron microscope and thereby calculating and obtaining the particle size of gold crystals of the gold plated film.

In general, the particle size of gold crystals required for a gold plated film varies depending upon its particular application, and in a field where high surface smoothness and glossiness are required, it is preferably at most 2 $\mu m^2$, more preferably at most 1 $\mu m^2$, most preferably at most 0.5 $\mu m^2$. According to the present invention, it is possible to deposit gold crystal particles sufficiently fine to meet such a requirement.

The gold plating solution of the present invention is very stable as is evident from the fact that gold will be readily dissolved at room temperature in a solution containing iodine and iodide ions in accordance with the following formula. Accordingly, even when contacted with dissolved oxygen or oxygen in the atmosphere, gold iodide complex ions in the gold plating solution can be present stably.

$$2Au+I_2+2I^- \rightarrow 2[AuI_2]^-$$

Further, the gold iodide complex ions in the gold plating liquid of the present invention are in an equilibrium represented by the following formula in the solution, whereby deposition of gold due to e.g. the above-mentioned disproportionation reaction ($3Au^+ \rightarrow 2Au+Au^{3+}$) scarcely takes place, and the gold iodide complex ions are excellent in stability.

$$[AuI_2]^-+I_3^- \leftrightarrows [AuI_4]^-+I^-$$

The gold plating solution of the present invention is an excellent gold plating solution which contains substantially no cyanide, whereby it is excellent in safety, the waste liquid treatment will be easy, and the load will be low. Here, "contains substantially no cyanide" means not to positively incorporate cyanide for the purpose of gold plating, and it is preferred that no cyanide is contained. For example, in a case where cyanide will be included as an impurity during the preparation of the gold plating solution of the present invention, the content of cyanide is, of course, preferably as small as possible, and specifically, it is preferably at most 1 wt %, more preferably at most 0.1 wt %, particularly preferably at most 0.01 wt %.

The gold plating method of the present invention is one wherein such a gold plating solution of the present invention is used, whereby it is possible to form a good gold plated film wherein gold crystal particles are fine and the grain boundaries are dense.

In the gold plating method of the present invention, it is preferred to carry out electrolytic plating by using gold or a gold alloy as the anode material, whereby gold as the anode will be dissolved into the plating solution to supply to the gold plating solution gold in an amount balanced to the gold in the gold plating solution decreased by plating, and thus stabilized plating can be carried out for a long period of time.

Further, according to the gold plating method of the present invention, plating of a gold alloy depending upon the particular purpose or application, can easily be carried out.

DETAILED DESCRIPTION OF THE PREFERRED EMBODIMENTS

Now, preferred embodiments of the gold plating solution and the gold plating method of the present invention will be described in detail.

The gold plating solution according to the first aspect of the present invention comprises iodide ions ($I^-$), gold iodide complex ions and a non-aqueous solvent.

The gold plating solution according to the second aspect of the present invention contains a water-soluble polymer in addition to iodide ions ($I^-$), gold iodide complex ions and a non-aqueous solvent.

The iodide ions in the gold plating solution of the present invention are preferably prepared by using an iodide. The cation of the iodide to be used is not particularly limited so long as it permits gold to be dissolved stably and it presents no adverse effect to the gold plating. Specifically, such a cation may, for example, be an alkali metal ion, an ammonium ion, a primary, secondary, tertiary or quaternary alkyl ammonium ion, a phosphonium ion or a sulfonium ion, preferably an alkali metal ion such as a sodium ion or a potassium ion, particularly preferably a potassium ion. These cations may be used alone or in combination of two or more cations.

The gold iodide complex ions in the gold plating solution of the present invention can be prepared in accordance with the following formula (1) or (2). Namely, there may, for example, be a method of preparing them by electrolytically dissolving gold in a solution containing iodide ions and a non-aqueous solvent or in such a solution having an oxidizing agent added, or a method of preparing them by dissolving gold in a solution comprising iodide ions, a non-aqueous solvent and an oxidizing agent.

$$Au+2I^- \rightarrow [AuI_2]^-+e^- \quad (1)$$

$$2Au+I_2+2I- \rightarrow 2[AuI_2]^- \quad (2)$$

Here, as the oxidizing agent, iodine ($I_2$) may directly be used, or an oxidizing agent to oxidize iodide ions ($I^-$) in the plating solution to $I_2$, may be used. As such an oxidizing agent, any optional one may be used so long as it is capable of oxidizing iodide ions ($I^-$) in the gold plating solution to $I_2$. For example, iodine ($I_2$), iodic acid ($HIO_3$), periodic acid ($HIO_4$) or a salt thereof, may be mentioned. Among them, it is preferred to use iodine ($I_2$) as the oxidizing agent when the gold plating solution of the present invention is to be prepared, taking into consideration the solubility in the solution and the stability in the solution.

The content of iodine element in the gold plating solution of the present invention may suitably be selected depending upon the amount of gold iodide complex ions to be contained in the gold plating solution. Namely, at the time of preparing the gold plating solution of the present invention, the amount of the oxidizing agent such as $I_2$ to be required for the desired dissolution amount of gold, may be selected as the case requires.

Accordingly, the content of iodine element in the gold plating solution of the present invention is not particularly limited, but it is usually at least 0.1 wt %, preferably at least 0.5 wt %, more preferably at least 1 wt %, particularly preferably at least 5 wt %. Further, the upper limit of this content is usually at most 75 wt %, preferably at most 50 wt %, more preferably at most 30 wt %, particularly preferably at most 20 wt %.

Here, the content of iodine element in the gold plating solution of the present invention represents a value, as calculated as iodine element, of the total amount of iodide ions and gold iodide complex ions in the gold plating solution and further, when $I_2$ is used to dissolve gold, its remaining amount. Such a value can be obtained by calculation from the amounts of raw materials to be filled when the plating solution of the present invention is prepared.

Further, in a case where the gold plating solution of the present invention contains both iodine ($I_2$) and iodide ions ($I^-$), the weight ratio of iodine ($I_2$) to iodide ions ($I^-$) (iodine ($I_2$):iodide ions ($I^-$)) is not particularly limited so long as gold can be stably dissolved, and unless the desired effects of the present invention will not be impaired.

However, if the iodine ($I_2$) content in the gold plating solution of the present invention is too much, there may be a case where, when a laminate of gold (or gold alloy) films is used as a cathode at the time of gold plating, dissolution of the electrode by iodine ($I_2$) in the gold plating solution is so much that the desired plating cannot be carried out. Accordingly, the iodine ($I_2$) content in the gold plating solution of the present invention is preferably as low as possible so long as the performance as the gold plating solution will not be impaired, and in a case where gold is used as the gold source, and iodine and iodide ions are used as the iodine source, the weight ratio of iodine ($I_2$):iodide ions ($I^-$) at the time of filling, is usually from 1:2 to 1:1,000, preferably from 1:3 to 1:100, more preferably from 1:5 to 1:30.

The gold plating solution of the present invention further contains a non-aqueous solvent. The gold plating solution of the present invention may contain the non-aqueous solvent and water. The type of the non-aqueous solvent is not particularly limited so long as plating can be carried out satisfactorily, and it provides a sufficient solubility for the solute. However, a compound having an alcoholic hydroxyl group and/or a phenolic hydroxyl group, or an aprotic organic solvent, is preferred.

As the compound having an alcoholic hydroxyl group, a monohydric alcohol such as methanol, ethanol, propanol or isopropanol; a dihydric alcohol such as ethylene glycol or propylene glycol; or a tri or higher polyhydric alcohol such as glycerol, may be employed.

Among them, one having two or more alcoholic hydroxyl groups, such as a dihydric alcohol or trihydric alcohol, is preferred. Specifically, ethylene glycol, propylene glycol or glycerol is preferred, and ethylene glycol is particularly preferred.

As the compound having a phenolic hydroxyl group, one having a single hydroxyl group such as unsubstituted phenol, o-, m- or p-cresol or an alkyl phenol such as xylenol, or one having two hydroxyl groups, such as a resorcinol, or one having three hydroxyl groups, such as a pyrogallol, may, for example, be used.

As the non-aqueous solvent, a compound having a functional group other than an alcoholic hydroxyl group or a phenolic hydroxyl group in its molecule, may also be used so long as it does not hinder the desired effects of the present invention. For example, a compound having an alkoxy group together with an alcoholic hydroxyl group, such as methylcellosolve or cellosolve, may also be used.

The aprotic organic solvent may be a polar solvent or a non-polar solvent.

The polar solvent may, for example, be a lactone solvent such as γ-butyrolactone, γ-valerolactone or δ-valerolactone; a carbonate solvent such as ethylene carbonate, propylene carbonate or butylene carbonate; an amide solvent such as N-methylformamide, N-ethylformamide, N,N-dimethylformaide, N,N-diethylformamide, N-methylacetamide, N,N-dimethylacetamide or N-methyl pyrrolidinone; a nitrile solvent such as 3-methoxy propylonitrile or glutalonitrole; or a phosphate solvent such as trimethyl phosphate or triethyl phosphate.

The non-polar solvent may, for example, be hexane, toluene or silicone oil.

These non-aqueous solvents may be used alone or in combination of two or more of them.

In the gold plating solution of the present invention, a particularly preferred non-aqueous solvent is ethylene glycol, propylene glycol, glycerol or γ-butyrolactone alone or its mixture with any one of the above-mentioned non-aqueous solvents.

The content of the non-aqueous solvent in the gold plating solution of the present invention is usually at least 10 wt %, preferably at least 30 wt %, more preferably at least 50 wt %, particularly preferably at least 55 wt % and usually at most 95 wt %, preferably at most 90 wt %, more preferably at most 85 wt %, particularly preferably at most 80 wt %, based on the entire gold plating solution.

In a case where the gold plating solution contains water, the content is usually at least 1 wt %, preferably at least 5 wt %, further preferably at least 7 wt %, particularly preferably at least 10 wt %, and usually at most 85 wt %, preferably at most 50 wt %, more preferably at most 40 wt %, particularly preferably at most 30 wt %, based on the entire gold plating solution.

The proportion of water to the non-aqueous solvent is usually at least 1 wt %, preferably at least 5 wt %, more preferably at least 7 wt %, particularly preferably at least 10 wt %, and usually at most 90 wt %, preferably at most 60 wt %, more preferably at most 50 wt %, particularly preferably at most 40 wt %.

The reason as to why it has been made possible to carry out gold plating effectively by incorporating the non-aqueous solvent to the gold plating solution, is not clearly understood. However, it is conceivable that by the presence of the non-aqueous solvent, generation of gas due to hydrolysis of water at the cathode is suppressed, whereby the efficiency in reduction and deposition of gold is improved.

The gold plating solution according to the second aspect of the present invention is characterized in that it further contains a water-soluble polymer. In the present invention, the "polymer" is a "polymer in a broad sense" including an "oligomer".

The type of the water-soluble polymer is not particularly limited so long as plating can be carried out satisfactorily, and it has a sufficient solubility in the medium. However, in consideration of the solubility in the gold plating solution and the storage stability, etc., it is preferably one having at least one group selected from the following substituents and connecting groups (D1) to (D3) in the main chain or side chain in the repeating unit structure:

(D1): at least one acidic substituent selected from the group consisting of —$CO_2H$, —$SO_3H$ and $PO_3H_2$, (D2): at least one basic substituent or connecting group selected from the group consisting of —CONR—, —$CH_2$—NR—$CH_2$—, —$NR_2$ and —$NR_3^+$ (wherein R is a hydrogen atom, a $C_{1-4}$ alkyl group, a methylene group or a halogen atom, provided that when two or more R are present in one substituent, they may be the same or different), and (D3): —OH being a non-electrolyte substituent.

The water-soluble polymer having the above substituent or connecting group (D1) to (D3) may, for example, be a synthetic organic substance such as polyvinyl alcohol, polyacrilamide, polyacrylic acid, polyvinyl pyrrolidone, a water-soluble alkyd, polyvinyl ether, a polymaleic acid copolymer or polyethylene imine; a semisynthesized product such as soluble starch, carboxyl starch, British rubber, dialdehyde starch, dextrin, cyclodextrine, cation starch, viscose, methyl cellulose, ethyl cellulose, carboxymethyl cellulose or hydroxyethyl cellulose; or an organic natural product such as starch, laver, agar, an alginate, gum Arabic, tragacanth gum, abelmoschus, amorphophalus, animal glue, casein, gelatin, egg white, plasma protein, pullulan or dextrin.

These water-soluble polymers may be used alone or in combination of two or more of them.

Among these water-soluble polymers, more preferred is one having an alcoholic hydroxyl group and/or —CONR— (wherein R is a hydrogen atom, a $C_{1-4}$ alkyl group, a methylene group or a halogen atom) as a water-soluble functional group. Specifically, polyvinyl alcohol, starch, soluble starch, carboxyl starch, dextrin, cyclodextrin, polyacrylamide or polyvinyl pyrrolidone may be mentioned. Particularly preferred is polyvinyl pyrrolidone alone or its mixture with any one of the above-mentioned water-soluble polymers.

The molecular weight of the water-soluble polymer is not particularly limited so long as plating can be carried out satisfactorily, and it has sufficient solubility in the medium. However, it is preferably from 500 to 3,000,000, more preferably from 1,000 to 2,000,000, most preferably from 5,000 to 1,500,000, as the weight average molecular weight.

Further, the content of the water-soluble polymer in the gold plating solution is not particularly limited so long as it is at a concentration where it is soluble in the gold plating solution. However, it is preferably at least 0.0001 wt %, more preferably at least 0.0005 wt %, most preferably at least 0.001 wt %, and preferably at most 5 wt %, more preferably at most 1 wt %, most preferably at most 0.5 wt %.

The gold source for the gold plating solution of the present invention may, for example, be a gold alloy or is gold as simple substance. However, with a view to preventing inclusion of impurities in the plating solution, simple substance gold or gold iodide is, for example, preferred. Among them, simple substance gold is preferred from the viewpoint of availability. The simple substance gold may be in any form of block, foil, plate, particles or powder, depending upon the process for producing the gold plating solution.

Further, in the present invention, alloy plating may be carried out by dissolving at least one metal other than gold in the gold plating solution of the present invention. The metal other than gold may, for example, be copper, silver or tin, which is well known for a gold alloy (Kotoda, Hyomen Gijutsu, 47(2), 142(1996)). However, other metals may be employed so long as they can be dissolved in the gold plating solution of the present invention. At that time, in order to dissolve the metal other than gold, an anion other than an iodide ion may be added unless it hinders the desired effects of the present invention.

For the same reason as it is preferred to employ simple metal gold as the gold source, in the case of preparing a gold alloy plating solution, in view of the influence over the composition of the plating solution, it is preferred to employ simple substance metals having the same composition as the alloy for the plated film to be obtained. In such a case, taking into the dissolution rate into consideration, there may be a case where as the alloy composition, a composition slightly departed from the composition of the plated film is employed.

The gold plating solution of the present invention may further contain an additive other than the water-soluble polymer, which is capable of improving the characteristics of the plated film. Such an additive may be at least one substance selected from additives and other substances which have been commonly used in known cyanide type or sulfite type plating solutions, unless it hinders the desired effects of the present invention.

The amount of such an additive is not particularly limited, and a proper amount may be determined taking into the effects and costs into consideration.

Among these additives, it is preferred to add a leveling agent, a brightener, a crystal regulator, etc., whereby it is possible to control the crystal growth and orientation at the time of reduction and deposition of gold ions at the cathode and to improve crystal microsizing at the plated film grain boundaries, smoothness of the plated surface and glossiness of the plated film.

Further, it is possible to add a completing agent in order to improve the stability of the gold plating solution, or a dissolution-accelerating agent to accelerate electrolytic dissolution when gold or a gold alloy is employed for an anode as a dissolving electrode. Further, it is possible to add various surfactants to improve wettability of the object to be plated, with the solution.

Further, it is possible to add a buffering agent to adjust the pH for the purpose of improving the stability of the gold plating solution and the reduction and deposition efficiency, various inorganic and organic conductive salts for improving the conduction, or various reducing agents as agents to adjust reduction and deposition of gold ions. Also with respect to these additives, the amount of their addition are not particularly limited, and proper amounts may be selected taking the effects and costs into consideration.

Among the above-mentioned additives, as a leveling agent, brightener or crystal regulator, various inorganic and organic additives may be employed. As an inorganic additive, it preferably contains a transition metal element or an element in Groups 3B to 6B of the Periodic Table, more preferably an element in Groups 4 to 6. Most preferred is an inorganic additive containing an element such as arsenic, thallium, selenium, lead, cadmium, tellurium, bismuth, antimony, tungsten or cerium among such elements.

Whereas, as the organic additive, an organic compound containing at least one type of oxygen, nitrogen and sulfur atoms, is preferred. Among such organic compounds, one having, as a functional group, ethylene oxide, an ester, a ketone, an ether, an alcohol, ethylene amine, ethylene imine, thiol or disulfide, is more preferred. Particularly preferred is a compound having a polyethylene oxide, polyamine or polyethylene imine structure, or a compound having a functional group such as a thiol, a disulfide or an amine. Such a compound may, for example, be polyethylene glycol, polyethylene imine, an alkylthiol such as ethanethiol, 2-hydroxyethanethiol, propanethiol or thioglycerol, or a disulfide such as dimethyl sulfide, 4,4'-dithiobutylic acid or bis-3-sulfopropyl disulfide-2-sodium salt. Such a compound may have another functional group so long as the desired function of the present invention will not be impaired. Further, among the above-mentioned additives, an optional one type may be used or two or more types may be used in combination among the inorganic additives and organic additives. Further, as an assisting agent for such a leveling agent, brightener or crystal regulator, halogen ions may be added.

Further, the complexing agent to be used for improving the stability of the gold plating solution, preferably has a main coordinate group to form a metal chelate, and various amines, oxyms, imines, thioethers, ketones, thioketones, alkoxy compounds, thiolates, carboxylic acids, phosphoric acids or sulfonic acids, may, for example, be mentioned. These complexing agents may be used alone or may be used in suitable combination of two or more of them. Among them, those having coordinate groups such as carboxylic acids, ketones, amines or imines, are preferred. As compounds having such coordinate groups, tartaric acid, citric acid, acetylacetone, ethylene diamine, nitrilotriacetic acid, ethylenediamine tetraacetic acid, 2,2'-bipyridine and 1,10-phenanthroline may, for example, be preferably employed.

Further, the dissolution-accelerating agent to be used when gold or a gold alloy is used as an anode, is not particularly limited so long as it is a compound suitable to accelerate the electrolytic dissolution of the anode. However, a compound having an oxidizing action is preferred. As such an oxidizing agent, a halogen, a halogen acid or a perhalogen acid is more preferred, and iodine, iodic acid, periodic acid or a salt thereof, is preferably employed.

Further, as the surfactant for the purpose of improving the wettability of the object to be plated or improving the penetration property into a narrow space for the object to be plated, an anionic, cationic, amphoteric or nonionic surfactant may be mentioned. Among them, an anionic, amphoteric or nonionic surfactant is preferred, and particularly preferred is an anionic or nonionic surfactant. Such surfactants may be used alone or may be used in suitable combination of two or more of them. The anionic surfactant may be of a carboxylic acid type, a sulfonic acid type, a sulfate type or a phosphate type; the amphoteric surfactant may be of an amino acid type or a betaine type; and the nonionic surfactant may, for example, be a polyethylene glycol type, a polyhydric alcohol type, an acetylene alcohol type or an alkanol amide type.

Among anionic surfactants, preferred are compounds of a sulfonic acid type (having a —$SO_3$— group), a sulfate type (having —$OSO_3$— group) or a carboxylic acid type (having a —$CO_2$— group) i.e. having at least one of —$SO_3$—, —$OSO_3$— and —$CO_2$— groups. They may be used alone or may be used in suitable combination-of two or more of them. Specifically, an alkyl sulfonic acid, an alkylbenzene sulfonic acid, an alkyl sulfuric ester, an alkyl ether sulfuric ester, an alkyl carboxylic acid, or a salt thereof, is preferably employed.

Among the nonionic surfactants, a polyethylene glycol type such as a polyoxyethylene alkyl ether, a polyoxyethylene alkyl phenyl ether, a polyoxyethylene fatty acid ester or a polyoxyethylene sorbitan fatty acid ester, a polyalkylene glycol type such as a polyoxyethylene polyoxypropylene ether or a polyoxyethylene polyoxypropylene alkyl ether, a polyhydric alcohol such as a glycerol fatty acid ester or a sorbitan fatty acid ester, an acetylene alcohol type such as an alkyn-ol or an alkyn-diol, or an alkanol amide type such as an alkyl carboxylic acid monoethanol amide or an alkylcarboxyric acid diethanolamide, may, for example, be mentioned. Among these surfactants, it is preferred to employ an alkyn-(di)ol or an alkylcarboxylic acid diethanolamide from the viewpoint that it is excellent in the chemical stability and the solubility in the plating solution.

Further, the buffer agent or conductive salt for the gold plating solution is not particularly limited so long as it shows ionic dissociation. However, boric acid, a carboxylic acid, carbonic acid, sulfurous acid, sulfuric acid, hypophosphorous acid, phosphoric acid, diphosphoric acid, a halogen acid, an alkali metal or alkaline earth metal hydroxide, aqueous ammonia, various amines, a diamine, a quaternary ammonium, or an alkali metal, alkaline earth metal or ammonium salt thereof, may, for example, be preferably employed. Such buffer agents or conductive salts may be used alone or may be used in suitable combination of two or more of them. Among such buffer agents or conductive salts, a carboxylate, a sulfate, a phosphate or a diphosphate is more preferred. Among them, a potassium, sodium or ammonium salt of tartaric acid, citric acid, maleic acid, lactic acid, fumaric acid, succinic acid, hydrogen iodide, sulfuric acid, phosphoric acid or diphosphoric acid, is, for example, preferably employed from the viewpoint of the stability and the solubility in the gold plating solution.

Further, the agent for adjusting the deposition rate of gold ions is not particularly limited unless it hinders the desired effects of the present invention. However, a compound having a reducing ability is preferably employed. Among them, a hypophosphite, a hydrogenated borate, a dialkylaminoborane, a hydrazine, an alkyldiamine, an aldehyde, a urea or a thiol may, for example, be more preferably employed. Among such agents for adjusting the deposition rate, thiourea is particularly preferably employed which shows an oxidation reduction potential without depending upon the pH of the gold plating solution.

The method for producing the gold plating solution of the present invention is not particularly limited. It can be obtained by mixing the gold source, the iodine source, the non-aqueous solvent, the water-soluble polymer and other optional additives. Preferably, a method is employed wherein gold or a gold alloy is dissolved at room temperature in a solution containing iodine, iodide ions, the non-aqueous solvent and optional water and other additives, whereupon the water-soluble polymer is added.

The gold plating method of the present invention can be carried out by a known electrolytic plating method by using the gold plating solution of the present invention. Usually, a constant current plating is carried out, but it may be a constant voltage plating or a pulse plating method such as a PR method. The current density in the case of a constant current plating is usually from 1 to 1,000 mA/$cm^2$, preferably from 2 to 300 mA/$cm^2$, more preferably from 3 to 50 mA/$cm^2$, particularly preferably from 4 to 20 mA/$cm^2$.

The gold plating solution of the present invention contains both iodine and iodide ions, whereby it has a high ability of dissolving gold.

In the electrolytic plating method employing the gold plating solution of the present invention, if plating is carried out by using gold or a gold alloy to form a plated film, as the material for an electrode (anode) opposite to an electrode (cathode) on the side where gold is deposited and plated, it is possible to supply the gold or gold alloy component from the anode while carrying out plating at the cathode, whereby a stabilized operation will be possible wherein the gold concentration or the alloy component concentration in the gold plating solution is maintained to be always constant. By using gold or a gold alloy as the anode in this manner, plating can be carried out for a long time, and it is possible to prolong the useful life of the plating solution. When gold or a gold alloy is used as the anode, the composition and the shape are preferably suitably adjusted taking into consideration the decomposition of the gold plating solution, etc.

Now, specific embodiments of the present invention will be described with reference to Examples and Comparative Examples. However, it should be understood that the present invention is by no means restricted to such specific Examples. In Examples 1 to 3 and Comparative Example 1, as gold, one having a purity of 99.99% manufactured by Kabushiki Kaisha Rare Metallic, was used, and as iodine, potassium iodide and ethylene glycol, the respective guaranteed reagents manufactured by Wako Pure Chemical Industries, Ltd. were used. Further, as γ-butylolactone, a high purity solvent manufactured by Kishida Chemical Co., Ltd. was used. In Examples 4 to 8 and Comparative Examples 2 and 3, as gold, pure gold having a purity of 99.99% manufactured by ISHIFUKU Metal Industry Co., Ltd., and as iodine, a product having a purity of 99.7% manufactured by GODO SHIGEN SANGYO CO., LTD., were used. With respect to other reagents, the guaranteed reagents manufactured by Wako Pure Chemical Industries, Ltd. were used to carry out the evaluation.

EXAMPLE 1

To 1.1 g of a liquid having 2.8 g of gold, 25.3 g of potassium iodide, 2.9 g of iodine and 12.9 g of water mixed, 2.6 g of ethylene glycol was mixed to obtain a gold plating solution comprising 2 wt % of gold, 17 wt % of potassium iodide, 2 wt % of iodine, 9 wt % of water and 70 wt % of ethylene glycol. The content of iodide ions in this gold plating solution at the time of filling, was 13 wt %, and the content of iodine element having the above-mentioned iodine content put together, was 15 wt %.

Using the obtained gold plating solution, plating was carried out on a gold sputtered film (cathode) using platinum as a counter electrode (anode) for 30 minutes at a current density of 5 mA/cm$^2$, whereby plating was done at a voltage of about 2 V.

With respect to the obtained plated film and the undercoating sputtered film, the depth profile of the elements was analyzed by the Auger electron spectroscopy, whereby the plated film was found to be a film composed mainly of gold.

Here, the time required for sputtering the entire gold film having the plated film and the undercoating put together, was about three times to the undercoating, whereby the plated film was confirmed to have a sufficient film thickness.

EXAMPLE 2

A gold plating solution was prepared in the same manner as in Example 1 except that 2.7 g of γ-butylolactone was used instead of ethylene glycol while using 1.2 g of the same mixture of gold, potassium iodide, iodine and water as in Example 1, and plating was carried out in the same manner as in Example 1, whereby plating was done at a voltage of about 2 V. Further, the content of iodide ions at the time of filling was 14 wt %, and the content of iodine element having 2 wt % of the content of iodine ($I_2$) put together, was 16 wt %.

With respect to the obtained plated film and the undercoating sputtered film, the depth profile of the elements was analyzed by Auger electron spectroscopy, whereby the plated film was found to be a film composed mainly of gold. Here, the time required for sputtering the entire gold film having the plated film and the undercoating put together, was about four times to the undercoating, whereby the plated film was confirmed to have a sufficient film thickness.

EXAMPLE 3

A gold plating solution was prepared and plating was carried out in the same manner as in Example 1 except that a gold sputtered film was used as the counter electrode (anode) in Example 1, whereby plating was done at a voltage of about 2 V. Further, plating was carried out continuously for a long period of time, whereby the gold sputtered film of the counter electrode was all dissolved to expose the substrate.

COMPARATIVE EXAMPLE 1

A gold plating solution was prepared in the same manner as in Example 1 except that 2.3 g of water was used instead of ethylene glycol while using 1.0 g of the same mixed liquid of gold, potassium iodide, iodine and water as in Example 1. Using the obtained gold plating solution, plating was carried out on a gold sputtered film (cathode) using platinum as a counter electrode (anode) at a current density of 5 mA/cm$^2$, whereby decomposition of the plating solution occurred at a low voltage of not more than 1 V, and it was impossible to carry out plating.

EXAMPLE 4

To 30 g of a liquid having 0.6 g of gold, 0.6 g of iodine, 5.1 g of potassium iodide, 18 g of ethylene glycol and 5.7 g of water mixed and dissolved, 22.8 g of ethylene glycol, 7.2 g of water, 0.48 g of tartaric acid and 3.6 g of potassium diphosphate were further added, stirred and dissolved. To this solution, 0.0064 g of polyvinyl pyrrolidone K85-95 (manufactured by ACROS Company, weight average molecular weight: 1,300,000) was added and dissolved to obtain a gold plating solution of the present invention. The respective concentrations in this gold plating solution at the time of filling were 0.9 wt % of gold, 0.9 wt % of iodine, 8.0 wt % of potassium iodide, 63.7 wt % of ethylene glycol and 20.1 wt % of water, and the content of iodine element in the gold plating solution was 7.0 wt %.

Using the obtained gold plating solution, plating was carried out on a gold sputtered film (cathode) using pure gold as a counter electrode (anode) for 30 minutes at a current density of 5 mA/cm$^2$, whereby plating was done at a voltage of about 0.20 V.

With respect to the obtained plated film, the number of gold crystal particles per unit area was counted by surface observation from the top surface by means of a scanning electron microscope (JEOL-6320F, manufactured by JEOL Ltd.) under 5,000 magnifications, whereby the gold crystal particle size of the gold plated film was calculated and was found to be less than 0.01 μm$^2$ on average, as calculated by a microscale of the electron microscope.

EXAMPLE 5

A gold plating solution of the present invention was prepared in the same manner as in Example 4 except that in Example 4, 0.0064 g of polyvinyl pyrrolidone K90 (manufactured by Wako Pure Chemical Industries, Ltd., weight average molecular weight: 360,000) was used as the water-soluble polymer, and plating was carried out in the same manner, whereby plating was done at a voltage of about 0.20 V. Here, the content of iodine element in the old plating solution was 7.0 wt %, like in Example 4.

With respect to the obtained plated film, the surface observation was carried out in the same manner as in Example 4, whereby the gold crystal particle size of he gold plated film was less than 0.01 μm$^2$ on average, as calculated by a microscale of the electron microscope.

EXAMPLE 6

A gold plating solution of the present invention was prepared in the same manner as in Example 4 except that in Example 4, 0.064 g of polyvinyl pyrrolidone K25 (manufactured by Wako Pure Chemical Industries, Ltd., weight average molecular weight: 35,000) was used as the water-soluble polymer, and plating was carried out in the same manner, whereby plating was done at a voltage of about 0.15 V. Here, the content of iodine element in the gold plating solution was 7.0 wt %, like in Example 4.

With respect to the obtained plated film, the surface observation was carried out in the same manner as in Example 4, whereby the gold crystal particle size of the gold plated film was 0.06 $\mu m^2$ on average, as calculated by a microscale of the electron microscope.

EXAMPLE 7

A gold plating solution of the present invention was prepared in the same manner as in Example 4 except that in Example 4, 0.064 g of polyvinyl pyrrolidone K16-18 (manufactured by ACROS Company, weight average molecular weight: 8,000) was used as the water-soluble polymer, and plating was carried out in the same manner, whereby plating was done at a voltage of about 0.12 V. Here, the content of iodine element in the gold plating solution was 7.0 wt %, like in Example 4.

With respect to the obtained plated film, the surface observation was carried out in the same manner as in Example 4, whereby the gold crystal particle size of the gold plated film was 0.13 $\mu m^2$ on average, as calculated by a microscale of the electron microscope.

EXAMPLE 8

A gold plating solution of the present invention was prepared in the same manner as in Example 4 except that in Example 4, 0.0064 g of polyvinyl alcohol (manufactured by Wako Pure Chemical Industries, Ltd., weight average molecular weight: about 2,000) was used as the water-soluble polymer, and plating was carried out in the same manner, whereby plating was done at a voltage of about 0.15 V. Here, the content of iodine element in the gold plating solution was 7.0 wt %, like in Example 4.

With respect to the obtained plated film, the surface observation was carried out in the same manner as in Example 4, whereby the gold crystal particle size of the gold plated film was 0.44 $\mu m^2$ on average, as calculated by a microscale of the electron microscope.

COMPARATIVE EXAMPLE 2

To 30 g of a liquid having 0.6 g of gold, 0.6 g of iodine, 5.1 g of potassium iodide, 18 g of ethylene glycol and 5.7 g of water mixed and dissolved, 6 g of ethylene glycol, 24 g of water, 0.48 g of tartaric acid and 3.6 g of potassium diphosphate were further added, stirred and dissolved to obtain a gold plating solution. The respective concentrations in this gold plating solution at the time of filling were 0.9 wt % of gold, 0.9 wt % of iodine, 8.0 wt % of potassium iodide, 37.5 wt % of ethylene glycol and 46.3 wt % of water, and the content of iodine element in the gold plating solution was 7.0 wt %.

Using the obtained gold plating solution, plating was carried out in the same manner as in Example 4, whereby plating was done at a voltage of about 0.51 V.

With respect to the obtained plated film, the surface observation was carried out in the same manner as in Example 4, whereby the gold crystal particle size of the gold plated film was 7.19 $\mu m^2$ on average, as calculated by a microscale of the electron microscope.

COMPARATIVE EXAMPLE 3

To 30 g of a liquid having 0.6 g of gold, 0.6 g of iodine, 5.1 g of potassium iodide, 18 g of ethylene glycol and 5.7 g of water mixed and dissolved, 22.8 g of ethylene glycol, 7.2 g of water, 0.48 g of tartaric acid and 3.6 g of potassium diphosphate were further added, stirred and dissolved to obtain a gold plating solution. The respective concentrations in this gold plating solution at the time of filling were 0.9 wt % of gold, 0.9 wt % of iodine, 8.0 wt % of potassium iodide, 63.7 wt % of ethylene glycol and 20.1 wt % of water, and the content of iodine element in the gold plating solution was 7.0 wt %.

Using the obtained gold plating solution, plating was carried out in the same manner as in Example 4, whereby plating was done at a voltage of about 0.10 V.

With respect to the obtained plated film, the surface observation was carried out in the same manner as in Example 4, whereby the gold crystal particle size of the gold plated film was 2.40 $\mu m^2$ on average, as calculated by a microscale of the electron microscope.

As is evident from the foregoing results, by using the gold plating solution of the present invention wherein a water-soluble polymer is added, the crystal particle size becomes fine at a level of at most 2 $\mu m^2$ in each case, as compared with the gold plating solution wherein a water soluble polymer is not added, whereby it is possible to obtain a gold plated film having high surface smoothness and glossiness.

According to the present invention, a gold plating solution is provided which is safe and stable while having a performance comparable to the cyanide type gold plating solution. Further, with the gold plating solution according to the second aspect of the present invention which has no toxicity and which is safe and has high stability of the solution, it becomes possible to easily and simply form a gold plated film wherein the crystal particles are fine and grain boundaries are dense, whereby it becomes possible to apply it to ornamental components which are required to have high surface smoothness and glossiness or to electronic components such as connector terminals or printed circuit boards.

The entire disclosures of Japanese Patent Application No. 2002-068691 filed on Mar. 13, 2002 and Japanese Patent Application No. 2003-159637 filed on Jun. 4, 2003 including specifications, claims and summaries are incorporated herein by reference in their entireties.

What is claimed is:

1. A gold plating solution, comprising:

iodine, iodide ions, gold iodide complex ions, at least 10 wt % of a non-aqueous solvent and 1-85 wt % water, based on the weight of the plating solution.

2. The gold plating solution according to claim 1, wherein the content of elemental iodine ranges from 0.5 to 50 wt %.

3. The gold plating solution according to claim 1, wherein the non-aqueous solvent is at least one member selected from the group consisting of a compound having an alcoholic hydroxyl group and/or a phenolic hydroxyl group, and an aprotic organic solvent.

4. The gold plating solution according to claim 3 wherein the compound having an alcoholic hydroxyl group has at least two alcoholic hydroxyl groups.

5. The gold plating solution according to claim 1, which contains substantially no cyanide.

6. A gold plating method, comprising:

coating a substrate with the gold plating solution as defined in claim 1.

7. The gold plating method according to claim 6, which is an electrolytic plating method.

8. The gold plating method according to claim 7, wherein the electrolytic plating is conducted in a cell having an anode of gold or a gold alloy.

9. A gold plating solution, comprising:

iodine, iodide ions, gold iodide complex ions, at least 10 wt % of a non-aqueous solvent and 1-85 wt % water, based on the weight of the plating solution, and a water soluble polymer.

10. The gold plating solution according to claim 9, wherein the content of elemental iodine ranges from 0.5 to 50 wt %.

11. The gold plating solution according to claim 9, wherein the non-aqueous solvent is at least one member selected from the group consisting of a compound having an alcoholic hydroxyl group and/or a phenolic hydroxyl group, and an aprotic organic solvent.

12. The gold plating solution according to claim 11, wherein the compound having an alcoholic hydroxyl group has at least two alcoholic hydroxyl groups.

13. The gold plating solution according to claim 11, wherein the non-aqueous solvent is at least one member selected from the group consisting of ethylene glycol, propylene glycol, glycerol and γ-butyrolactone.

14. The gold plating solution according to claim 9, wherein the water-soluble polymer has at least one group selected from the following substituents and connecting groups consisting of (D1) to (D3) in the main chain or side chain in the repeating unit structure of the polymer:

wherein (D1) is at least one acidic substituent selected from the group consisting of —$CO_2H$, —$SO_3H$ and $PO_3H_2$, (D2) is at least one basic substituent or connecting group selected from the group consisting of —CONR—, —$CH_2$—NR—$CH_2$—, —$NR_2$ and —$NR_3^+$ wherein R is a hydrogen atom, a $C_{1-4}$ alkyl group, a methylene group or a halogen atom, provided that when two or more R groups are present in one substituent, they may be the same or different, and (D3) is —OH, as a non-electrolyte substituent.

15. The gold plating solution according to claim 14, wherein the water-soluble polymer has, as a water-soluble functional group, an alcoholic hydroxyl group and/or —CONR—, wherein R is a hydrogen atom, a $C_{1-4}$ alkyl group, a methylene group or a halogen atom.

16. The gold plating solution according to claim 15, wherein the water-soluble polymer is at least one member selected from the group consisting of polyvinyl alcohol, polyvinyl pyrrolidone, starch and cyclodextrin.

17. The gold plating solution according to claim 9, which contains substantially no cyanide.

18. A gold plating method, comprising:

coating a substrate with the gold plating solution as defined in claim 9.

19. The gold plating method according to claim 18, which is an electrolytic plating method.

20. The gold plating method according to claim 19, wherein the electrolytic plating is conducted in a cell having an anode of gold or a gold alloy.

21. A gold plating solution, comprising:

iodine, iodide ions, gold iodide complex ions, at least 10 wt % of a non-aqueous solvent of ethylene glycol or γ-butylolactone, and 1-85 wt % water, based on the weight of the plating solution.

* * * * *